US006135028A

United States Patent [19]

Kuhns et al.

[11] Patent Number: 6,135,028

[45] Date of Patent: Oct. 24, 2000

[54] PENETRATING DUAL-MODE WARHEAD

[75] Inventors: Lucia D. Kuhns, King George; Leonard T. Wilson, Spotsylvania, both of Va.

[73] Assignee: The United States of America as represented by the Secretary of the Navy, Washington, D.C.

[21] Appl. No.: 09/170,971

[22] Filed: Oct. 14, 1998

[51] Int. Cl.[7] ..... F42B 12/20

[52] U.S. Cl. ..... 102/499; 102/265; 102/270; 102/271; 102/473; 102/518

[58] Field of Search ..... 102/262, 265, 102/266, 270, 271, 308, 389, 473, 476, 478, 489, 491–497, 499, 500, 503, 518

[56] References Cited

U.S. PATENT DOCUMENTS

| | | | |
|---|---|---|---|
| 2,411,862 | 12/1946 | Arnold | 102/476 |
| 4,256,039 | 3/1981 | Gilman | 102/52 |
| 4,573,412 | 3/1986 | Lovelace et al. | 102/374 |
| 4,770,101 | 9/1988 | Robertson et al. | 102/489 |
| 4,774,889 | 10/1988 | Wallow et al. | 102/517 |
| 5,107,766 | 4/1992 | Schliesske et al. | 102/473 |
| 5,111,746 | 5/1992 | Pentel et al. | 102/308 |
| 5,157,225 | 10/1992 | Adams et al. | 102/493 |
| 5,162,607 | 11/1992 | Steiner | 102/364 |
| 5,370,055 | 12/1994 | Fugelso et al. | 102/308 |
| 5,507,893 | 4/1996 | Mullay et al. | 149/76 |
| 5,526,752 | 6/1996 | Dahl et al. | 102/517 |
| 5,596,166 | 1/1997 | Gould | 102/362 |
| 5,656,792 | 8/1997 | Rentzsch et al. | 102/489 |
| 5,698,814 | 12/1997 | Parsons et al. | 102/478 |
| 5,872,324 | 2/1999 | Watson, Jr. et al. | 102/265 |
| 5,939,662 | 8/1999 | Bootes et al. | 102/473 |

FOREIGN PATENT DOCUMENTS

| | | | |
|---|---|---|---|
| 433254 | 6/1991 | European Pat. Off. | 102/476 |
| 2472168 | 6/1981 | France | 102/489 |
| 308435 | 2/1920 | Germany | 102/489 |
| 3424237 | 1/1986 | Germany | 102/473 |

*Primary Examiner*—Harold J. Tudor
*Attorney, Agent, or Firm*—James B. Bechtel, Esq.; Wyatt B. Pratt, Esq.

[57] ABSTRACT

A penetrating, dual-mode warhead having soft target, surface burst mode and a hard target, penetrating mode is provided. The warhead has a cylindrical outer fragmenting shell which contains an explosive surround. A long-rod penetrator with an explosive payload is located within the outer fragmenting shell. By arming selection prior to launch, the warhead can be configured for the surface burst mode which uses proximity sensor to initiate the outer shell explosive. The outer shell initiates the penetrator payload thereby detonating both explosives and fragmenting both the shell and penetrator casing. In the penetrating mode, the outer shell is stripped away on impact but is initiated just as the penetrator exits the shell. By this method the penetrator remains undamaged, but the outer shell nevertheless detonates to engage any surface targets. The penetrator continues into the hardened target, detonating on either a void sensor or on timing, whichever occurs first.

17 Claims, 3 Drawing Sheets

PENETRATING DUAL-MODE WARHEAD

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention described herein relates to warheads and in particular to dual-mode, fragmenting and penetrating warheads.

BACKGROUND OF THE INVENTION

Developing technology in hypersonic missile systems provides potentially improved kill mechanisms. A key feature of these missiles is the ability to deliver payloads at high terminal velocities in excess of 4000 ft./sec. Such high terminal velocities will allow weapons to penetrate heavily fortified structures provided that the missile delivers a structurally sound penetrator. Typically, structural strength depends on increased metal structure and thick-walled cases. In contrast, weapons for surface targets require fragmenting warheads which require thin-walled cases and large explosive charges. An example is the general purpose (GP) MK 82 bomb. While hypersonic penetrating weapons can defeat deeply buried structures due to their high terminal velocity, these weapons will not perform well against surface targets for two reasons (1) their small payloads, and (2) their thick-walled cases. In hypersonic penetrating weapons, explosive volume must be sacrificed to metal structure in order to survive penetration. This means the energy to drive fragments is not available. At the same time, the thick casing needed for structural purposes does not readily break up into the small fragments needed to destroy surface targets. Current weapons, such as, General Purpose (GP) bombs are generally delivered at subsonic velocities. GP bombs have little capability against deeply buried structures, yet they are highly effective against soft targets vehicles because they are large diameter devices that project a large number of high velocity metal fragments. What is needed is a means of providing a structurally-strong penetrator for hardened targets and a fragmenting, general purpose warhead for surface targets. In view of the opposing design criteria developing a single warhead capable of both deep penetration and general purpose fragmentation remains challenging.

SUMMARY OF THE INVENTION

It is an object of the invention to provide a penetrating, dual-mode warhead having both a penetrating mechanism and a fragmenting mechanism.

It is another object of the invention to provide a penetrating, dual-mode warhead having a fragmenting outer shell.

It is yet another object of the invention to provide a penetrating, dual-mode warhead having a hardened inner penetrating warhead.

Accordingly, the invention is a penetrating, dual-mode warhead comprising an outer fragmenting shell forming a cylindrical enclosure surrounding a long-rod, penetrating warhead. The outer fragmenting shell comprises an outer fragmenting shroud, which forms the warhead casing, and an explosive surround located within the fragmenting shroud. The long-rod, penetrating warhead comprises a penetrating core with a main explosive charge. During warhead impact on a hardened target, the outer shroud and explosive surround are stripped away from the penetrating warhead. The penetrating warhead exiting the outer shell initiates the explosive surround. This sequence allows the penetrator to separate from the fragmenting mechanism prior to detonation of the fragmenting mechanism. This separation prevents the interference of the fragmenting charge with the penetrator. During impact with a soft target, the external shroud and surround explosive is not stripped away. In this sequence, the penetrator's main charge is detonated by the fragmentation charge and both charges contribute to the surface blast.

BRIEF DESCRIPTION OF THE DRAWINGS

The foregoing objects and other advantages of the present invention will be more fully understood from the following detailed description and reference to the appended drawings wherein corresponding reference characters indicate corresponding parts throughout the several views of the drawings and wherein.

DETAILED DESCRIPTION OF THE INVENTION

Figure 1:
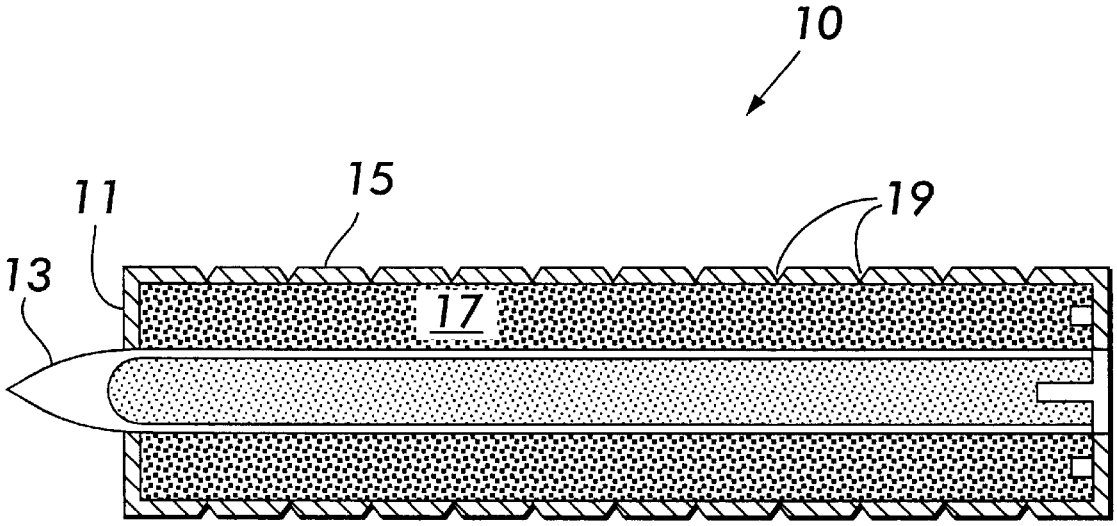
FIG. 1 is a cut-away side view of the penetrating, dual-mode warhead.

Referring now to FIG. 1, the overall penetrating, dual-mode warhead, designated generally by the reference numeral 10, is shown with its major components. The dual-mode warhead relies on impact velocity (4000–6000 feet/sec) as the primary kill mechanism in the penetrating mode. Explosive fragmentation is the primary kill mechanism in the soft target mode. The penetrating, dual-mode warhead 10 comprises a cylindrical outer fragmenting shell 11 enclosing a centermounted, long-rod, penetrating warhead 13. The outer fragmenting shell 11 comprises a fragmenting shroud 15, (which provides a casing) and an explosive surround 17. The explosive surround preferably comprises an explosive. Most preferably, the explosive is shock insensitive. Suitable explosives include TATB, RDX, and HMX-based explosives. The fragmenting shroud 15 has longitudinal striations 18 and circumferential striations 19 around the exterior of the fragmenting shroud 15 to facilitate uniform break-up of the shroud during surface detonations.

Figure 2:
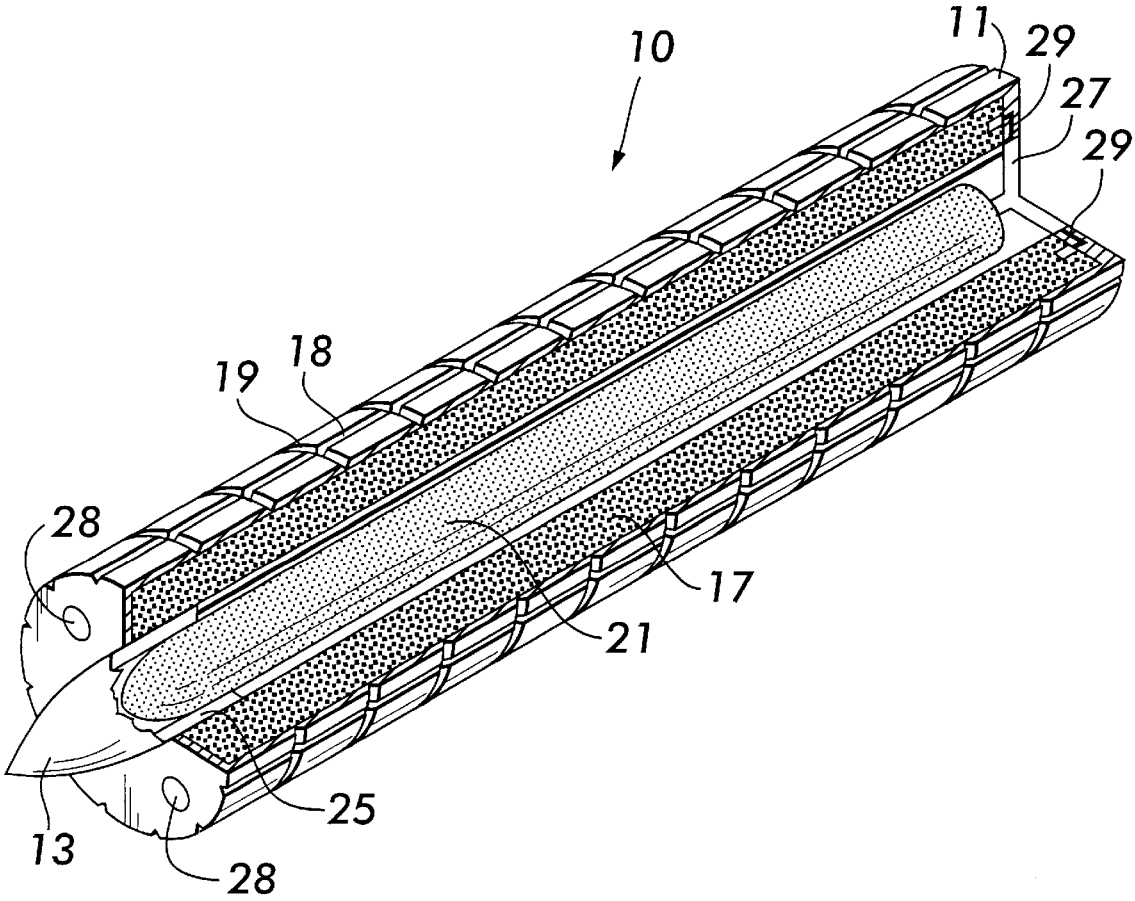
FIG. 2 is a perspective view of the penetrating, dual-mode warhead with a one-quarter section cut-away.

FIG. 2 depicts a cutaway of the penetrating, dual-mode warhead 10 showing the subcomponents of the long-rod, penetrating warhead 13 and the fuzing mechanism 27 between the penetrating warhead 13 and the outer shell 11. The fuzing assembly comprises an instantaneous initiator, 25 and a fuzing mechanism 27 which comprises a void-sensing initiator using a back-up timer. During penetration of hardened targets, the outer shell 11 is stripped away from the penetrating warhead 13. During this process, the connectors 29 between the explosive surround 17 and the fuzing mechanism 27 are severed, the fuzing mechanism 27 remaining with the penetrating warhead 13. As the penetrating warhead 13 exits the fragmenting shell 11, the instantaneous initiators 25 are actuated. In this mode, the instantaneous initiators 25 are actuated by the final longitudinal movement of the penetrator 13 as it leaves the fragmenting shell 11. By this process, the outer fragmenting shell 11 is detonated after the penetrating warhead 13 is clear of the shell 11. The detonating shell 11 provides a surface burst to engage any surface target while the penetrator remains undamaged in the penetration mode. The fuzing mechanism 27, although severed from the outer fragmenting shell 11, continues to function for initiation of the penetrator explosive payload 21. The fuzing mechanism 27 contains a timer and a void sensor. By this means, the penetrating warhead 13 is exploded, using a shock-insensitive explosive such as, TATB (triaminotrinitrobenzene), RDX (hexahydrotrinitrotriazine) or HMX (octahydrotetranitrotetrazine)-based explosives, after a fixed penetration time or immediately if deceleration changes. The change in deceleration occurs when the hardened target is breached and the penetrator enters a hollow space within the target. In this case, the warhead is immediately detonated, thereby preventing warhead pass-through on lightly armored targets.

In the event that the warhead impacts a soft target, such as a truck, aircraft or other lightweight structure, the outer shell 11 will not be separated from the penetrator 13. In this case, the fuzing mechanism 27 provides both timing and deceleration sensing (the standard penetrator mode). However, when the fuzing mechanism actuates the initiators, the connectors 29 to the outer shell have not been severed and both the penetrator payload 21 and the explosive surround 17 in the fragmenting shell 11 are detonated. Ordinarily, a different algorithm is required for a concrete penetrating mode versus a lightly-armored target penetrating mode. In the event the algorithm is set for concrete, the warhead ordinarily will not detonate with impact on a truck or aircraft. The deceleration level will be too low compared to the expected deceleration for concrete. However, in the event that the target is interdiction of a concrete reinforced runway, aircraft on the runway or on a ramp would likely be destroyed as the explosive surround will be separated from the penetrator and explode on the runway surface. When used as a penetrator against soft targets such as light-weight bunkers and lightly-armored vehicles, a preferred mode would be to use the soft-target mode using both proximity and void sensors. The proximity sensor will sense the target approaching and enable the fuze to calculate a detonation point inside the target as a back up in case the deceleration is insufficient to trigger the void sensor (or missile impact is slightly off target, thereby failing to enter the target void).

Figure 3:
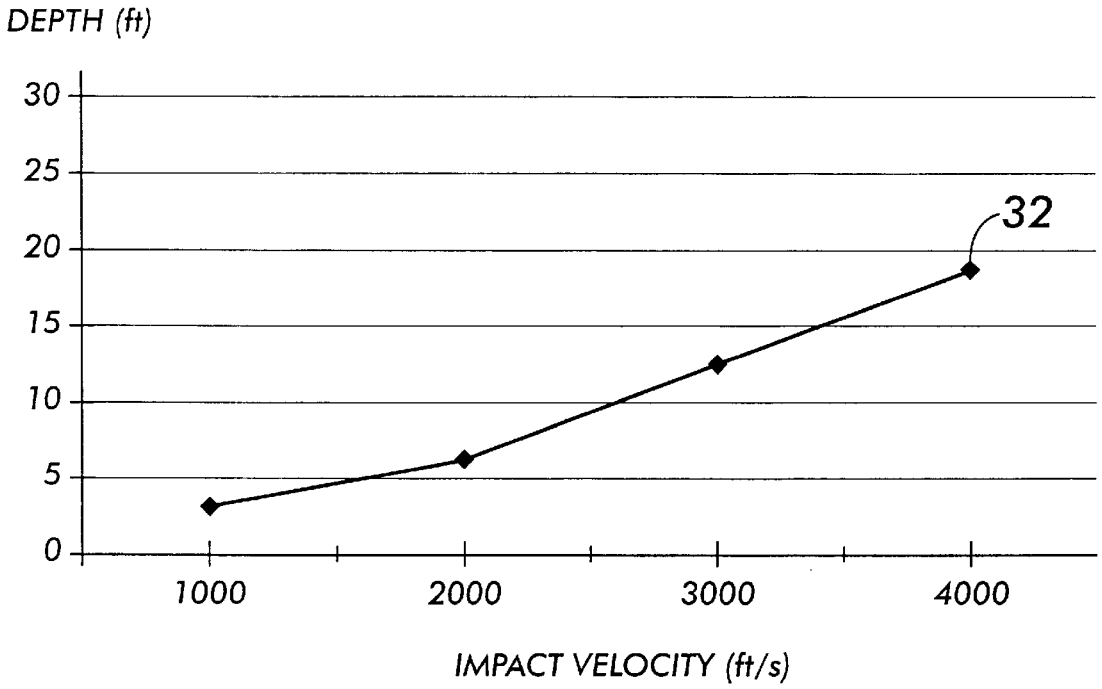
FIG. 3 is a chart showing warhead penetration into reinforced concrete as a function of impact velocity.

The soft target, surface-burst mode uses proximity sensor 28 to provide for a stand-off detonation of both explosives by actuating ignitor 25 and initiators in fuzing mechanism 27. Referring now to FIG. 3, the penetration of the warhead 13 in 5 ksi concrete is shown as a function of impact velocity. With a 175 pound penetrator striking the concrete target at 4000 fps, a penetration depth of approximately eighteen feet is achieved, as shown by point 32 on the graph.

The features and advantages of the invention are numerous. The warhead allows hypersonic weapons to attack deeply buried targets while providing general purpose capability, that is, a soft target capability equivalent to current GP bombs and warheads. The unique construction also allows control of the fragmentation footprint of the warhead so that uniform coverage of the target area can be obtained using the surface-burst mode.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A penetrating, dual-mode warhead comprising:

a fragmenting, explosive outer shell forming a cylindrical enclosure containing an explosive surround;

a penetrating warhead located within said fragmenting, explosive outer shell, said penetrating warhead containing an explosive payload, said penetrating warhead having a length greater that the length of said outer shell;

a multi-mode fuzing assembly comprising a fuzing mechanism for detonating said penetrating warhead and an instantaneous initiator for detonating the explosive outer shell,m said multi-mode fuzing assembly being selectively responsive to a proximity sensor located on said cylindrical enclosure and by the separation of the penetrating warhead from the outer shell.

2. A penetrating, dual-mode warhead as in claim 1 wherein said fragmenting, explosive outer shell further comprises an outer shell having a fragmenting shroud.

3. A penetrating, dual-mode warhead as in claim 2 wherein said fragmenting, explosive outer shell has a plurality of longitudinal and circumferential striations adapted to facilitate a uniform breakup of the shroud.

4. A penetrating, dual-mode warhead as in claim 1 wherein said explosive surround is formed with an explosive which is shock insensitive.

5. A penetrating, dual-mode warhead as in claim 1 wherein said explosive is a TATB-based explosive surround.

6. A penetrating, dual-mode warhead as in claim 1 wherein said explosive is a RDX-based explosive surround.

7. A penetrating, dual-mode warhead as in claim 1 wherein said explosive is a HMX-based explosive surround.

8. A penetrating, dual-mode warhead as in claim 1 wherein said penetrating warhead is a long-rod penetrator.

9. A penetrating, dual-mode warhead as in claim 5 wherein said fuzing mechanism includes a timer.

10. A penetrating, dual-mode warhead as in claim 9 wherein said fuzing mechanism further comprises a void sensor connected in parallel with said timer and is configured to provide instantaneous initiation upon changes in deceleration of said penetrating warhead.

11. A penetrating, dual-mode warhead as in claim 1 wherein said explosive payload comprises an explosive which is shock insensitive.

12. A penetrating, dual-mode warhead as in claim 1 wherein said explosive is a TATB-based explosive payload.

13. A penetrating, dual-mode warhead as in claim 1 wherein said explosive is a RDX-based explosive payload.

14. A penetrating, dual-mode warhead as in claim 1 wherein said explosive is a HMX-based explosive payload.

15. A penetrating, dual-mode warhead as in claim 1 wherein said instantaneous initiator is located within said fragmenting, explosive outer shell.

16. A penetrating, dual-mode warhead as in claim 1 wherein said fuzing assembly comprises a plurality of proximity sensors located on said fragmenting, explosive outer shell, which said plurality of proximity sensors are connected to said fuzing mechanism and said instantaneous initiator.

17. A penetrating, dual-mode warhead as in claim 16 wherein connections from said fuzing mechanism are severable from said fragmenting, explosive outer shell by longitudinal displacement of said penetrating warhead with respect to said fragmenting, explosive outer shell.

* * * * *